United States Patent [19]

Saccomani et al.

[11] Patent Number: 4,644,705

[45] Date of Patent: Feb. 24, 1987

[54] UNFOLDING, MOVABLE HOSPITAL UNIT

[75] Inventors: Daniel Saccomani, Maule; Bernard Tarin, Paris, both of France

[73] Assignee: Societe d'Etudes Techniques et d'Entreprise Generales Sodeteg, Le Plessis Robinson, France

[21] Appl. No.: 860,737

[22] Filed: May 7, 1986

[51] Int. Cl.[4] ..... E04H 3/08

[52] U.S. Cl. ..... 52/27; 52/29; 52/36; 52/67; 52/79.5; 52/238.1; 52/404

[58] Field of Search ..... 52/238.1, 67, 70, 2, 52/27, 29, 36, 79.5, 79.7, 404; 244/159, 160; 296/24 R

[56] References Cited

U.S. PATENT DOCUMENTS

| | | | |
|---|---|---|---|
| 2,552,691 | 5/1951 | Sauners | 52/67 |
| 2,677,571 | 5/1954 | Williams | 296/24 R |
| 3,213,628 | 10/1965 | Serota | 52/2 |
| 3,217,448 | 11/1965 | Heise | 52/36 |
| 3,441,101 | 4/1969 | Parnell | 296/156 |
| 3,948,314 | 4/1976 | Creswick | 52/2 |
| 4,073,101 | 2/1978 | Yoshida | 52/245 |
| 4,449,746 | 5/1984 | Clark | 296/24 R |

*Primary Examiner*—John E. Murtagh

*Attorney, Agent, or Firm*—Pollock, VandeSande & Priddy

[57] ABSTRACT

Movable hospital unit comprising a rigid, parallelepipedal structure which cannot be dismantled and which is extensible, comprising at least one bearing floor, without its own means of motion, with heat-insulating side walls, end walls and ceiling, and a fixed cross partition acting, all at once, as a water tank, a means of dividing the hospital unit into two zones, namely a utilities zone and a hospital zone, and a means of providing heat and sound insulation between these two zones.

17 Claims, 6 Drawing Figures

5
3
21
2
7
4
1

14
9
2
12
11
14
13
15
8
10
7
3
1

6
17
3
2
8
10
20
7
22
18
5
20

6
9
17
4
3
8
10
21
20
7
19
18
21
20
5

UNFOLDING, MOVABLE HOSPITAL UNIT

The present invention relates to an unfolding, movable hospital unit.

Movable hospitals are hospitals designed to cope with medical and surgical problems in all conditions, especially in the event of natural disasters or war, as swiftly as possible and whereever desired. Known movable hospitals are often either dismantable installations that are made up of elements that can be assembled, which are easy to pack, carry and mount or hospitals on wheels. Movable hospitals made up of installations that can be dismantled have the disadvantage of taking a relatively long time to be set up and put into operation. Hospitals on wheels are rapidly put into operation. However, they are often huge, and, for this reason, they cannot reach certain types of uneven terrain or terrain with narrow points of access, and are difficult to carry to distant places.

The object of the present invention, which is to remove these disadvantages, makes it possible to build an economical, unfolding movable hospital unit which is easy to carry by air, land and sea and can be swiftly set up and put into operation. According to the invention, a movable hospital unit comprises a rigid, parallelepipedal structure, which can be extended and cannot be dismantled, comprising at least one bearing floor without own means of motion, heat-insulating side walls, end walls and ceiling and a fixed, crosswise partition which has the function of a water tank, a means to divide the hospital unit into two zones, namely a utilities zone and a hospital zone, and a means to provide heat and sound insulation between these two zones.

For a better understanding of the invention, we have described a certain number of examples of realisation illustrated below by the appended drawings wherein.

Figure 1:
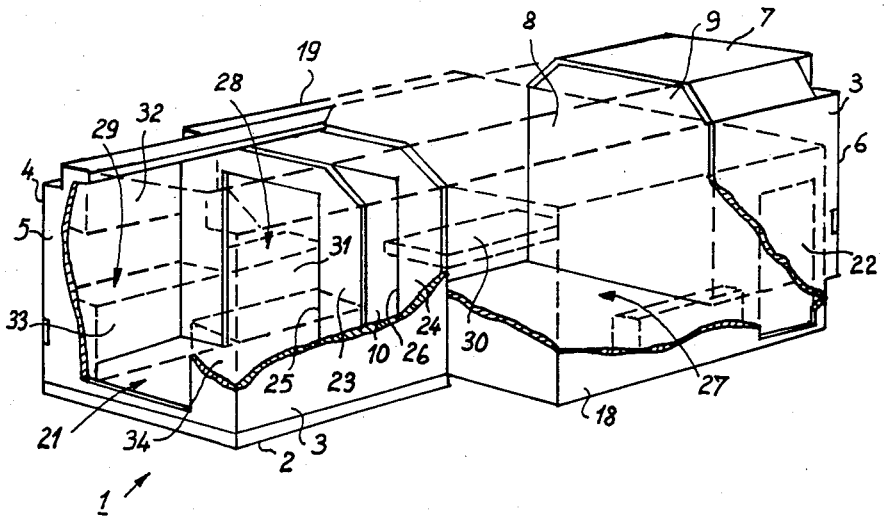
FIG. 1 represents a partially cut-away schematic view, seen in perspective, of an unfolding, movable hospital unit made according to the invention, showing this hospital unit in its unfolded state.

A movable hospital unit 1 made according to the invention, is designed to take medical aid equipment and/or surgical equipment as well as equipment for the production of energy and of the indispensable fluids so that this unit can function independently for a pre-determined period of time, and so that it can be carried by air, land or sea to the places where it is to be used.

According to a major characteristic of the invention, the movable hospital unit 1 comprises a rigid structure which is extensible and cannot be dismantled, with a rectangular parallelepipedal shape, comprising a bearing floor or bearing platform 2 which is rectangular, solid, resistant and dimensionally stable, possesses no inherent means of movement or locomotion and unfailingly supports the weight of the unit and that of its installations and facilities during the operation and transportation of this unit 1. The bearing floor 2 is made up of a wooden or metallic rectangular frame which is heat-insulated by glass wool or plastic foam and lined on its surface or surfaces by wooden or metallic plates. Rigid heat-insulating side walls 3, 4, and end walls 5, 6 and a rigid heat-insulating ceiling 7 are solidly fixed on this bearing floor. These walls are locally buttressed by metallic supports which are not shown in the figures and which are designed to provide rigidity to the unit 1, to hold the medical and/or surgical equipment in position and to provide framing for the openings or doors. The heat insulation of the bearing floor 2, the side walls 3, 4, the end walls 5, 6, and the ceiling 7 and the openings or doors is pre-determined so that the hospital unit 1 can work normally with an inside temperature ranging from +20° C. to +30° C., when the external temperature varies from −20° C. to +50° C.

Figure 5:
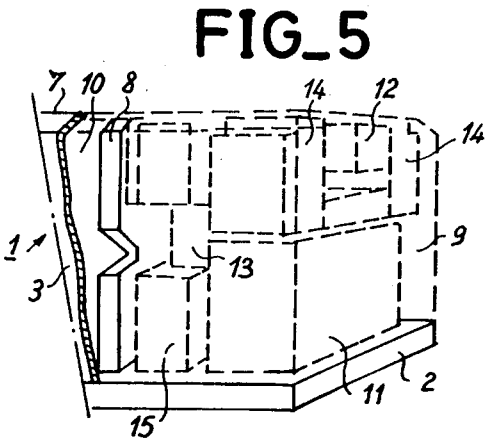
FIG. 5 represents on another scale, a partly cut-away perspective view of a part of the hospital unit of FIG. 1 showing its other end and, FIG. 6 represents on another scale an alternative embodiment of the hospital unit of FIG. 1.

The internal volume of the hospital unit 1 is divided by a fixed heat-insulating and sound-insulating cross partition into two zones, a utilities zone with a relativey small area 9, in which the energy and fluids production equipment is set up, and a hospital zone with a relatively large area 10 in which the medical and/or surgical equipment is mounted. The energy and fluids production equipment, shown schematically in FIG. 5 by dashes, are known types of equipment comprising at least one electrical power generating set 11 and a battery fitted with an inverted rectifier 12 to provide an independent electrical power supply for a pre-determined period to the hospital in operation, a compressed air and vacuum production plant 13, an air-conditioning plant 14, a plant 15 to produce gases for medical use such as oxygen and nitrogen monoxide, and a water supply tank.

According to another characteristic of the invention, the dividing cross partition 8 consists of a hollow partition or an alveolate structure which is used, all at once, as a means of dividing the hospital unit 1 spatially into two zones 9 and 10, as a water supply tank for this unit 1 and as an effective means of providing heat and sound insulation between these two zones. This type of structure of the partition 8 can be used to obtain a relatively large-capacity water tank and to save the space usually taken up by an independent or distinct water tank in this utilities zone 9. There should be efficient heat insulation and, above all, efficient sound insulation between the two zones 9 and 10, since the power generating set 11 and the compressed air and vacuum production and air-conditioning plants 13 and 14, create troublesome noise while working.

According to another characteristic of the invention, in the utilities zone 9, the power generating set 11 is mounted so that it is removable and can be withdrawn from its location at any chosen moment in order to be installed outside the hospital unit 1, so as to get rid of a major source of noise and, to some extent, a source of vibrations. To this effect, the power generating set is mounted either so that it is movable and can be locked into the rails or so that it is movable on a system of sliding supports according to known techniques not shown in the figures.

The hospital unit 1 comprises a utilities zone 9 with a fixed volume and a hospital zone 10 which can have its volume and horizontal area increased. The utilities zone 9 comprises an entrance door 17 formed either in the hollow cross partition 8 that separates the two zones 9 and 10 or in one of the side walls 3 or 4 or the end wall 6. In the example shown in FIGS. 2 and 3, the door 17 is formed in the side wall 4 near the end wall 6. The extensible hospital zone 10 comprises two removable, diametrically opposite compartments 18, 19, along a part of its length, mounted in two diametrically opposite openings, 20, 21, formed in its side walls 3 and 4 which are opposite to each other. The removable compartments 18, 19, can be folded in crossways and can be unfolded or extended sideways. These compartments 18, 19, are made up either of sliding compartments, like drawers, illustrated in FIGS. 1 to 5, mounted in a known type of sliding system comprising guide rails on their floors and ceilings, not shown in the figures, or by pivoting walls that fit into one another and can be unfolded like a fan represented in FIG. 6.

Figure 4:
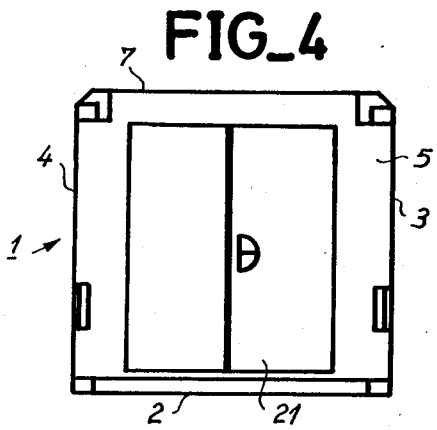
FIG. 4 represents a view from the end of the hospital unit of FIG. 2, showing its main entrance formed in one of its ends.
Figure 2:
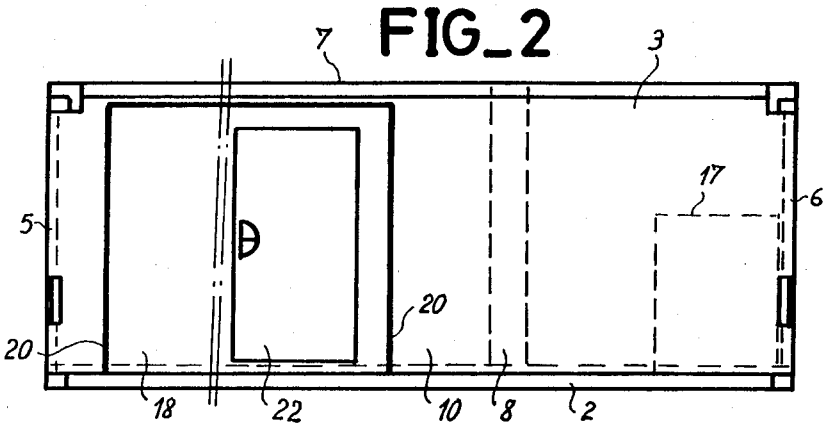
FIG. 2 represents, on another scale, a lateral view of the hospital unit of FIG. 1 in its retracted and folded-in state.
Figure 3:
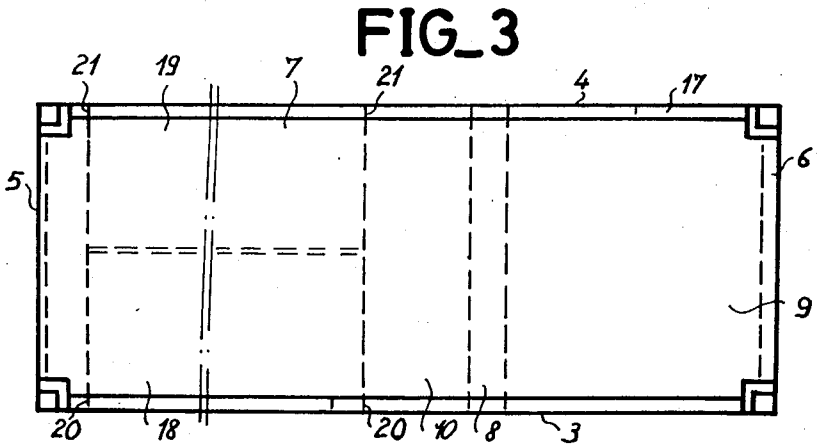
FIG. 3 represents a view from above of the hospital unit of FIG. 2.

While the hospital unit 1 is being used, the sliding compartments 18, 19, are locked in their unfolded position shown in FIG. 1, and when this unit 1 is being transported, these sliding compartments are locked in their folded-in position represented in FIGS. 2 to 4.

Figure 6:
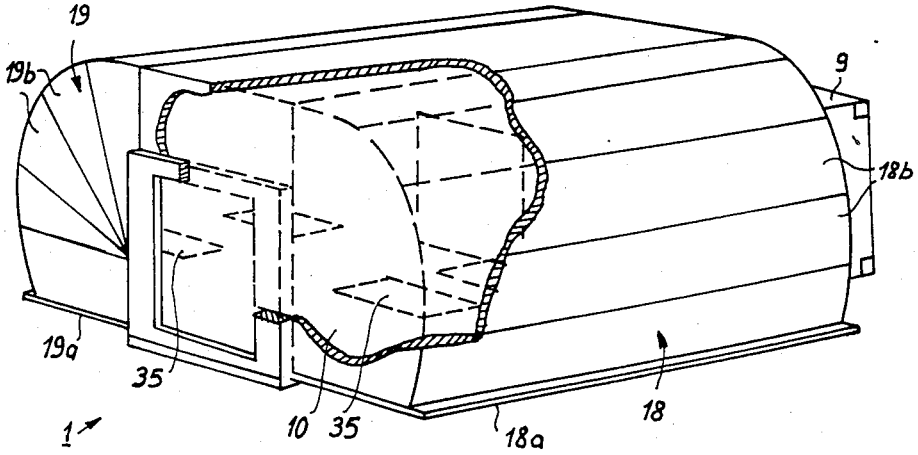

In the example illustrated in FIG. 6, the movable compartments 18 and 19 each comprise a plane wall 18*a* or 19*a*, pivoting around a horizontal axis and acting as a floor for this compartment, and composite, side walls made up of pivoting sectorial elements 18*b* or 19*b*, which can be fitted into one another. While the hospital unit 1 is being used, the plane walls 18*a* and 19*a* and the composite, side walls, 18*b* and 19*b* of these compartments 18 and 19 are locked in their unfolded postion illustrated in FIG. 6, and when this unit 1 is being transported, these walls are put in their folded-in position (not represented in the figures) which restores to the hospital unit 1 the shape of a rectangular parallelepiped, similar to the one illustrated in FIGS. 2 to 4, a shape that makes for easy transportation and storage.

According to another characteristic, the hospital zone 10 comprises at least two ways of access, one main entrance made up of a large door 21, with more than one leaf, formed in the end wall 5 of the hospital unit 1 opposite to the wall 6 that closes the utilities zone 9, and a secondary entrance made up of a relatively narrow side door with one leaf 22 formed in one of the side walls 3 and 4. In the example shown in FIGS. 1 and 2, the door 22 of the secondary entrance is formed in the side wall of one compartment 18 of the removable compartments 18, 19, forming a part of the side wall 3.

If necessary, the hospital unit 1 comprises, in the hospital zone 10, one or more movable cross partitions 23, 24, by which it is possible to compartmentalize the hospital zone 10 into spaces for specific uses.

In a hospital unit used for surgery, for example (FIG. 1), the movable cross partitions 23, 24, divide the hospital zone 10 into an operating space 27, a space for personnel to get prepared 28, and a space for preparing equipment 29. The operating space 27 will be fitted up, in particular, with an operating table, 30, lighting, anesthetic and X-ray equipment and electricity, medical fluids and vacuum connectors. The personnel space 28 is provided with connections for the supply of oxygen, a washbasin 31 and a locker, while the equipment-preparing space 29 comprises sterilizing instruments 32 and ultrasonic cleaning instruments, a bench top 33 and a blood bank 34.

In the hospital unit 1, used for treatment or medical aid, the hospital zone 10 requires a large space to set up beds 35, a piece of furniture for miscellaneous uses and reanimation equipment (FIG. 6). In this case, the movable cross partitions 23, 24, are not used.

According to the invention, the hospital unit 1, made with a rigid bearing floor 2 which can be laid on or fastened to any support, can easily be transported by plane, helicopter, truck, train or ship and can be swiftly set up and put into operation in the desired places.

In the illustrated example of an embodiment (FIGS. 2 and 3), the hospital unit 1 in its folded-in state, with the shape of a rectangular parallelepiped, has a length of about 9,125 millimeters corresponding to 30 feet and a width and height of about 2,438 millimeters corresponding to 8 feet.

By unfolding the removable compartments 18 and 19, it is possible to increase the dimensions of the hospital zone 10 of the hospital unit 1 by a multiplying factor of about 1.5 to 2.

In addition to a panel to monitor and start up the energy and fluids production and air supply equipment, the hospital unit 1 has a panel setting up links for switching over between this equipment and external sources of energy, fluids and water, and links for switching over between the internal and external telephone and/or radio communications facilities. Thus, at any chosen moment, these external sources and facilities take over the functions of the energy and fluid producing and water supply equipment and those of the internal switching installations proper to the hospital unit 1.

The hospital unit 1 comprises its own attachment or fastening facilities, of a known type not shown in the figures, at its end which is closed by a main entrance door 2. The hospital unit is thus transformed into a modular hospital unit that can be connected to any hospital block with attachment or fastening facilities that complement or match its own attachment or fastening facilities, so that the treatment, surgical or receiving capacity of the hospital unit can be extended.

We claim:

1. Movable hospital unit comprising a rigid, parallelepipedal, extensible structure that cannot be dismantled, comprising at least one bearing frame without its own means of motion, with heat-insulating side walls, end walls and ceiling and a fixed cross partition used, all at once, as a water tank, a means to divide the hospital unit into two zones, i.e. a utilities zone and a hospital zone, and as a means of providing heat and sound insulation between these two zones.

2. Hospital unit according to claim 1, wherein it comprises an extensible hospital zone comprising movable compartments which can be folded in crossways and unfolded sideways.

3. Hospital unit according to claim 1, wherein the fixed cross partition comprises a hollow partition.

4. Hospital unit according to claim 1, wherein the fixed cross partition is made up of a partition with an alveolate structure.

5. Hospital unit according to claim 1 wherein the utilities zone comprises equipment for the production of energy and fluids and the hospital zone comprises equipment for medical care and/or surgery.

6. Hospital unit according to claim 5 wherein, in the utilities zone, the energy production equipment comprises at least one movable power generating set.

7. Hospital unit according to claim 6 wherein, in the utilities zone, the power generating set is mounted so that it can be moved and locked on rails.

8. Hospital unit according to claim 6 wherein, in the utilities zone, the power generating set is mounted so that it can be moved and locked on a system of sliding supports.

9. Hospital unit according to claim 6 wherein, in the utilities zone, the power generating set is mounted so that it is can be moved and locked on a system of retractable wheels.

10. Hospital unit according to claim 2 wherein, in the hospital zone, the removable compartments are made up of sliding compartments in the manner of drawers.

11. Hospital unit according to claim 2 wherein, in the hospital zone, the movable compartments are made up of compartments with pivoting walls that fit into one another and can be unfolded like a fan.

12. Hospital unit according to claim 1 wherein it comprises, in the hospital zone, at least two ways of access, namely one main entrance consisting of a door with more than one leaf, formed in an end wall, and a secondary door consisting of a single-leaf door formed in one of the side walls.

13. Hospital unit according to claim 1 wherein it comprises, in the hospital zone, movable cross partitions that divide it into spaces for specific uses such as an operating space, a space for personnel to get prepared and an equipment-preparing space.

14. Hospital unit according to claim 5 wherein it comprises a panel to monitor and start up the energy and fluids production and water supply equipment and a panel providing a switch-over link between this equipment and external sources of energy, fluids and water and a switch-over link between internal and external facilities for telephone and radio communications.

15. Hospital unit according to claim 12 wherein it comprises, in the end wall which has the main entrance door, its own attachment and fastening facilities which can be connected to any hospital block fitted with attachment and fastening facilities that complement these very facilities.

16. Hospital unit according to claim 1 wherein in its folded-in state, when it has the shape of a rectangular parallelepiped, it has a length of 9,125 millimeters corresponding to 30 feet and a width and height of 2,438 millimeters corresponding to 8 feet.

17. Hospital unit according to claim 2 wherein, in their unfolded state, the removable compartments increase the dimensions of the hospital zone by a multiplying factor of 1.5 to 2.

* * * * *